US007439798B2

(12) United States Patent
Kouno et al.

(10) Patent No.: US 7,439,798 B2
(45) Date of Patent: Oct. 21, 2008

(54) REGULATOR CIRCUIT

(75) Inventors: Kazuyuki Kouno, Takatsuki (JP); Norio Hattori, Kyoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 76 days.

(21) Appl. No.: 11/272,807

(22) Filed: Nov. 15, 2005

(65) Prior Publication Data

US 2006/0119421 A1 Jun. 8, 2006

(30) Foreign Application Priority Data

Nov. 17, 2004 (JP) ..... P2004-333312

(51) Int. Cl.
*G05F 1/10* (2006.01)
*G05F 3/02* (2006.01)

(52) U.S. Cl. ..... 327/541

(58) Field of Classification Search ..... 327/538, 327/540, 511, 543
See application file for complete search history.

(56) References Cited

U.S. PATENT DOCUMENTS 5,982,226 A * 11/1999 Rincon-Mora ..... 327/541
7,046,079 B2 * 5/2006 Van Blerkom et al. ..... 327/543

FOREIGN PATENT DOCUMENTS

JP 2000-331479 A 11/2000
JP 2002-083494 3/2002
JP 2002-312043 A 10/2002
JP 2004157613 A * 6/2004

OTHER PUBLICATIONS

Japanese Office Action, with English translation, issued in Japanese Patent Application No. JP2004-333312 dated on Jun. 13, 2008.

* cited by examiner

*Primary Examiner*—Quan Tra
(74) *Attorney, Agent, or Firm*—McDermott Will & Emery LLP

(57) ABSTRACT

A regulator circuit includes: a detection circuit, for outputting a feedback voltage in accordance with an output voltage; a reference voltage input section; a feedback voltage input section; an operational amplification circuit, for comparing a reference voltage and the feedback voltage and outputting a voltage as a comparison result; an output circuit, for supplying an output voltage in accordance with the output of the operational amplification circuit; a connection/disconnection circuit, for connecting or disconnecting the output terminal of the detection circuit and the feedback voltage input section; and a voltage setup circuit, for setting for the feedback voltage input section a predetermined voltage. In the standby state, the connection/disconnection circuit disconnects the output terminal of the detection circuit from the feedback voltage input section, and the voltage setup circuit sets a predetermined voltage for the feedback input section.

10 Claims, 10 Drawing Sheets

REGULATOR CIRCUIT

BACKGROUND OF THE INVENTION

1. Field of the Invention

The present invention relates to a regulator circuit, and relates particularly to a regulator circuit that can quickly recover from the halted state to the operating state.

2. Description of the Related Art

In order to generate a desired internal voltage, a regulator circuit is mounted in a semiconductor integrated circuit. The regulator circuit is used, for example, when a power voltage required for the internal operation of a semiconductor integrated circuit is to be generated based on an externally input power voltage. Also, for a semiconductor memory device, the regulator circuit is employed when a predetermined voltage used for a reading or a writing operation is to be generated based on a voltage output by a charge pump circuit.

Currently, a demand exists for low power consumption semiconductor integrated circuits that can be mounted in portable devices, such as cellular phones. In use, when such a semiconductor integrated circuit enters a standby state, a regulator circuit mounted thereon should be halted to limit the consumption of power. And later, when the semiconductor integrated circuit recovers from the standby state to the active state, the regulator circuit must be able to recover quickly and supply predetermined voltages.

FIG. 9 is a diagram showing the arrangement of a conventional regulator circuit. A regulator circuit 100 includes a detection circuit 11, for detecting an output voltage VOUT and for generating and outputting a voltage (a feedback voltage) VFB consonant with the output voltage VOUT; an operational amplification circuit 12, for comparing the output voltage VFB of the detection circuit 11 with a reference voltage VREF and outputting a comparison result VAOUT; and an output circuit 13, for supplying a current to the output terminal, based on the output voltage VAOUT of the operational amplification circuit 12, to maintain the fixed output voltage VOUT.

The detection circuit 11 is a series circuit that includes resistors R0 and R1, which are connected between the output voltage VOUT terminal and the ground voltage terminal, and an N-channel transistor N0. The feedback voltage VFB is extracted at the juncture of the resistors R0 and R1, and the gate of the N-channel transistor N0 is connected to a contact for a control signal ENREG.

The feedback voltage VFB is applied to the non-inverted input terminal of the operational amplification circuit 12 and the reference voltage VREF is applied to the inversion input terminal, and the operational amplification circuit 12 is driven by a power source HV. Further, the control signal ENREG is transmitted to the operational amplification circuit 12.

The output circuit 13 is a P-channel transistor P0, and the gate is connected to the output terminal VAOUT of the operational amplification circuit 12, the source is connected to the power source HV, and the drain is connected to the output terminal VOUT. In accordance with the output voltage VAOUT of the operational amplification circuit 12, a current is supplied to the output terminal VOUT.

The control signal ENREG is a control signal for controlling the starting and the halting of the operation of the regulator circuit 100. When the control signal ENREG is at level H, the N-channel transistor N0 in the detection circuit 11 is set to the ON state, the operational amplification circuit 12 is activated, and the regulator circuit 100 is set to the operating state. When the control signal ENREG is at level L, the N-channel transistor N0 in the detection circuit 11 is set to the OFF state, the operational amplification circuit 12 is inactivated, and the regulator circuit 100 is halted. At this time, the power consumed by the regulator circuit 100 drops to zero.

A decoupling capacitor 30 and a load circuit 31 are connected to the output terminal VOUT of the regulator circuit 100. The decoupling capacitor 30 is additionally provided in order to suppress the fluctuation of the output voltage VOUT. The load circuit 31 is a destination to which the output voltage is supplied, and an actual load is represented as a model by using a current source IL and a switch SW.

Hereinafter, assume this is a case wherein the reference voltage VREF=1.25 V, the power voltage HV=5.4 V and the output voltage VOUT=4.6 V. These voltage values are employed for a case wherein the regulator circuit generates a voltage of 4.6 V to be applied to a word line during a reading operation for a flash memory. The power voltage HV=5.4 V is generated by raising the internal power voltage of 1.8 V using the charge pump circuit.

FIGS. 10A and 10B are diagrams showing waveforms for various operations performed for the conventional regulator circuit. As shown in FIG. 10A, when the control signal ENREG is at level H, the regulator circuit is active (the operating state), and when the current has been consumed by the load circuit 31 (the switch SW is at level H), it supplies a current and maintains the fixed output voltage VOUT.

When the control signal ENREG is at level L, the regulator circuit 100 is in the standby state (the halted state), and the current consumed by the detection circuit 11 and the operational amplification circuit 12 is zero. When the load circuit 31 is to consume current while the regulator circuit is in the standby state, the control signal ENREG goes to level H and the regulator circuit recovers from the standby state to the active state and begins to supply a current to the load circuit 31.

As shown in FIG. 10B, the output voltage VOUT of the regulator circuit in the active state is 4.6V. Since a current is supplied to the load circuit 31 by the regulator circuit each time the current is consumed by the load circuit 31, the drop in the output voltage VOUT is a very small value, i.e., VD1, and the fixed value of the output voltage VOUT is maintained. At this time, the feedback voltage VFB, which is the input voltage for the operational amplification circuit 12, is a value (1.25 V) equal to the reference voltage VREF.

When at this time any current is not consumed by the load circuit 31, the control signal ENREG goes to level L and the regulator circuit is shifted to the standby state. At this time, the current consumed by the detection circuit 11 and the operational amplification circuit 12 is zero. Further, the power voltage HV is output by the output terminal VAOUT of the operational amplification circuit 12, and thus, the P-channel transistor P0 in the output circuit 13 is rendered OFF and the output terminal VOUT is set to a high impedance state.

As a result, the capacitance C of the decoupling capacitor 30 maintains the output voltage VOUT in the standby state at the voltage 4.6 V in the operating state. Since the N-channel transistor N0 in the detection circuit 11 is in the OFF state, the feedback voltage VFB is set so it is near the output voltage 4.6 V. When the load circuit 31 consumes current while the regulator circuit is in the standby state, the control signal ENREG goes to level H, and the regulator circuit recovers from the standby state to the active state and begins to supply a current to the load circuit 31 (see, for example, JP-A-2002-312043 and JP-A-2000-331479).

However, the conventional regulator circuit cannot quickly recover from the standby state to the active state. In the standby state, as shown in FIG. 10B, since the feedback voltage VFB is set so it is near the output voltage VOUT=4.6

V, a time T is required for the regulator circuit to recover from the standby state to the active state because, for a stable operation, the feedback voltage VFB is shifted from 4.6 V to VREF=1.25 V.

Since the load circuit 31 continuously consumes current during a period lasting until the regulator circuit is shifted to the stable operation state and begins to supply a current, there is a large voltage drop VD2 in the output voltage VOUT.

To prevent this voltage drop VD2, an increase in the value of the capacitance C of the decoupling capacitor 30 is considered. However, in this case, the chip area would be increased because a larger decoupling capacitor would be employed, and accordingly, the cost of the semiconductor integrated circuit would be increased.

SUMMARY OF THE INVENTION

To resolve these shortcomings, one objective of the present invention to provide a regulator circuit that can quickly recover from the standby state to the active state, without requiring an increase in the chip area.

To achieve this objective, a regulator circuit according to the present invention comprises:

a detection circuit, for outputting a feedback voltage in accordance with an output voltage;

a reference voltage input section;

a feedback voltage input section;

an operational amplification circuit, for comparing a reference voltage and the feedback voltage and outputting a voltage as a comparison result;

an output circuit, for supplying an output voltage in accordance with the output of the operational amplification circuit;

a connection/disconnection circuit, for connecting or disconnecting an output terminal of the detection circuit and the feedback voltage input section; and a voltage setup circuit, for setting for the feedback voltage input section a predetermined voltage.

It is preferable, when the regulator circuit of the present invention is activated, that the detection circuit and the operational amplification circuit be activated and the output terminal of the detection circuit and the feedback voltage input section be connected by the connection/disconnection circuit, and that the voltage setup circuit be set to the inactive state.

Further, it is preferable, when the regulator circuit of the present invention is halted, that the detection circuit and the operational amplification circuit stop the consumption of current and halt their operations, that the output terminal of the detection circuit and the feedback voltage input section be disconnected by the connection/disconnection circuit, and that for the feedback voltage input section a predetermined voltage be set by the voltage setup circuit.

It is also preferable that the activation and the halting of the regulator circuit of the invention be controlled in response to a control signal.

Furthermore, it is preferable, for the regulator circuit of the invention, that the connection/disconnection circuit include a first P-channel transistor for connecting or disconnecting the output terminal of the detection circuit and the feedback voltage input section.

Moreover, it is preferable, for the regulator circuit of the invention, that the voltage setup circuit can be set to a voltage near the reference voltage.

It is also preferable, for the regulator circuit of the invention, that the voltage setup circuit can be set to an internal power voltage used inside a semiconductor integrated circuit.

Further, it is preferable, for the regulator circuit of the invention, that the voltage setup circuit include a second P-channel transistor for setting the internal power voltage for the feedback voltage input section.

Furthermore, it is preferable, for the regulator circuit of the invention, that the voltage setup circuit can be set to the reference voltage.

Moreover, it is preferable, for the regulator circuit of the invention, that the voltage setup circuit include a third P-channel transistor for setting the reference voltage for the feedback voltage input section.

It is also preferable, for the regulator circuit of the invention, that the voltage setup circuit have a series-connection structure including at least one N-channel transistor, the gate and the drain of which are connected in common between the feedback voltage input section and a ground voltage terminal.

Further, it is preferable, for the regulator circuit of the invention, that after a predetermined time has elapsed following the shifting of the regulator circuit was shifted from a halted state to an operating state, the connection/disconnection circuit connects the output terminal of the detection circuit to the feedback voltage input section.

As described above, according to the regulator circuit of the invention, in the standby state (the halted state), the detection circuit and the feedback voltage input section can be disconnected, and a predetermined voltage can be set for the feedback voltage input section. Since in the standby state a voltage set for the feedback voltage input section is near the reference voltage, when the standby state is returned to the active state, the potential for the feedback voltage input section is changed, within a short period of time, to the reference voltage, which that is the a potential for a stable operation. Therefore, the quick recovery of the regulator circuit can be achieved.

Furthermore, since the internal power voltage used inside a semiconductor integrated circuit is employed as a voltage to be set for the feedback voltage input section in the standby state, a voltage near the reference voltage can be designated for the feedback voltage input section in the standby state, without the generation of a setup voltage for the feedback voltage input section being required. Thus, when in a short period of time the regulator circuit is recovered from the standby state to the active state, the potential of the feedback voltage input section can be set to the reference voltage, that is the potential for a stable operation. In this manner, the quick recovery of the regulator circuit can be achieved.

When the standby state and the active state are to be frequency shifted, the voltage setup should be quickly performed for the feedback voltage input section. There is no problem in performing this setup, because the voltage to be set in the feedback voltage input section is the internal power voltage.

Further, since the reference voltage is employed as a voltage to be set for the feedback voltage input section in the standby state, a new voltage to be set for the feedback voltage input section need not be generated. According to this arrangement, when the regulator circuit recovers from the standby state to the active state, the potential of the feedback voltage input section is set to the reference voltage, so that a quick recovery of the regulator circuit can be achieved.

In addition, a series-connection structure including at least one N-channel transistor, the gate and the drain of which are connected in common between the feedback voltage input section and the ground voltage terminal, is employed as means for setting a predetermined voltage for the feedback voltage input section in the standby state. According to this arrangement, the voltage set for the feedback voltage input section in the standby state is determined to be integer times a threshold voltage Vt of the N-channel transistor. When a transistor having an optimal threshold voltage is selected, a voltage, near the reference voltage, that does not depend on the power voltage can be set. With this arrangement, when the standby state is recovered to the active state, the potential for the feedback voltage input section is set, in a short period of time, to the reference voltage that is the potential for a stable operation, so that the quick recovery of the regulator circuit can be achieved.

After a predetermined period of time has elapsed following the shifting of the regulator circuit from the halted state to the operating state, the connection/disconnection circuit connects the output terminal of the detection circuit to the feedback voltage input section. According to this arrangement, when the active state is to be recovered from the standby state, the output terminal of the detection circuit and the feedback voltage input section can be connected after the output voltage of the detection circuit has been stabilized. Therefore, when the standby state is shifted to the active state, the feedback voltage input section is more quickly set to the reference voltage, which is the potential for a stable operation. Therefore, a quicker regulator circuit recovery can be achieved.

DESCRIPTION OF THE PREFERRED EMBODIMENTS

Figure 1:
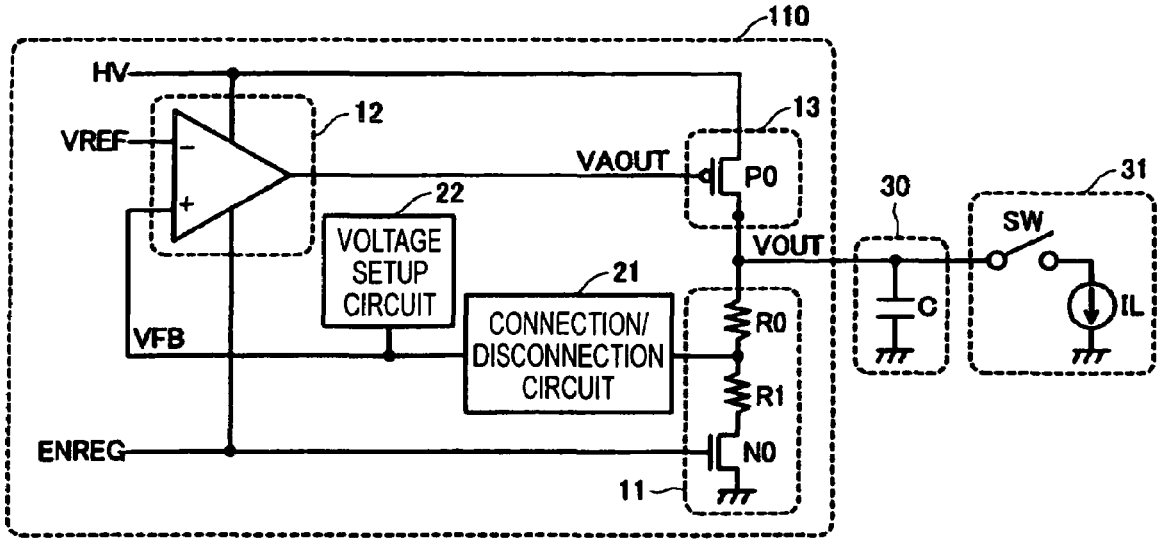
FIG. 1 is a diagram showing the configuration of a regulator circuit according to the present invention.

The preferred embodiments of the present invention will now be described in detail while referring to the drawings. FIG. 1 is a diagram showing the configuration of a regulator circuit according to the preferred embodiments of the present invention. In FIG. 1, the same reference numerals are employed to denote components having the same functions as those of the conventional regulator circuit previously described, and for them, no further description will be given. Only portions having different arrangements will be described.

A regulator circuit 110 according to the embodiments of the invention includes: a connection/disconnection circuit 21, for connecting or disconnecting the output terminal of a detection circuit 11 and a feedback input section VFB; and a voltage setup circuit 22, for setting a predetermined voltage for the feedback input section VFB.

When the regulator circuit 110 is in the operating state, the connection/disconnection circuit 21 connects the output terminal of the detection circuit 11 to the feedback input section VFB, and the voltage setup circuit 22 is set to the inactive state.

When the regulator circuit 110 is in the halted state, the detection circuit 11 and an operational amplification circuit 12 halt current consumption and stop the operations, the connection/disconnection circuit 21 disconnects the output terminal of the detection circuit 11 from the feedback input section VFB, and the voltage setup circuit 22 sets a predetermined voltage for the feedback input section VFB.

More detailed examples for the invention will be explained while referring to the drawings.

First Embodiment

Figure 2:
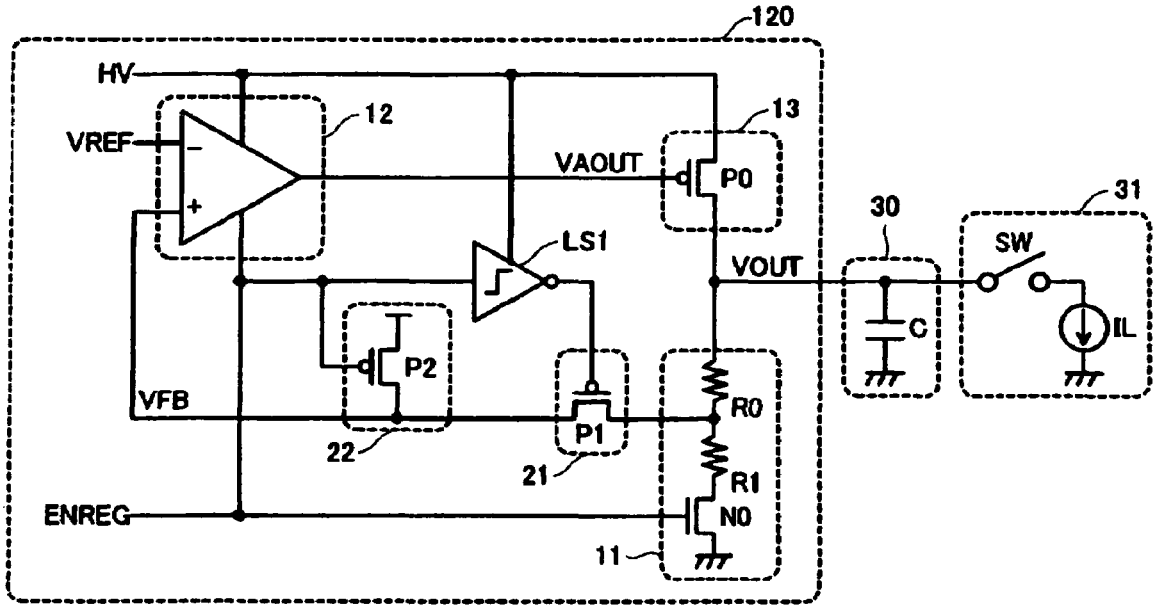
FIG. 2 is a diagram showing the configuration of a regulator circuit according to a first embodiment of the present invention.

FIG. 2 is a diagram showing the configuration of a regulator circuit according to a first embodiment of the present invention. In FIG. 2, the same reference numerals are employed to denote components having the same functions as those of the conventional regulator circuit previously described, and for them, no further explanation will be given. Only different portions will be described.

A regulator circuit 120 according to this embodiment includes: a connection/disconnection circuit 21, for connecting or disconnecting the output terminal of a detection circuit 11 and a feedback input section VFB; and a voltage setup circuit 22, for setting a predetermined voltage for a feedback input section VFB.

The connection/disconnection circuit 21 is constituted by a P-channel transistor P1, and the gate is attached to the output terminal of a level shifter circuit LS1. Based on a control signal ENREG, the P-channel transistor P1 either connects the detection circuit 11 to the feedback input section VFB, or disconnects the detection circuit 11 from the feedback input section VFB.

The level shifter LS1 shifts the voltage level of the control signal ENREG to a power voltage level HV, and the logic for the shifting is inverted logic (inverter).

The voltage setup circuit 22 is constituted by a P-channel transistor P2. The source of the P-channel transistor P2 is connected to the 1.8 V internal power source used by a semiconductor integrated circuit, the drain is connected to the feedback input section VFB, and the gate is connected to a contact for the control signal ENREG. Based on the control signal ENREG, the P-channel transistor P2 sets the 1.8 V internal power voltage for the feedback input section VFB.

Figure 3:
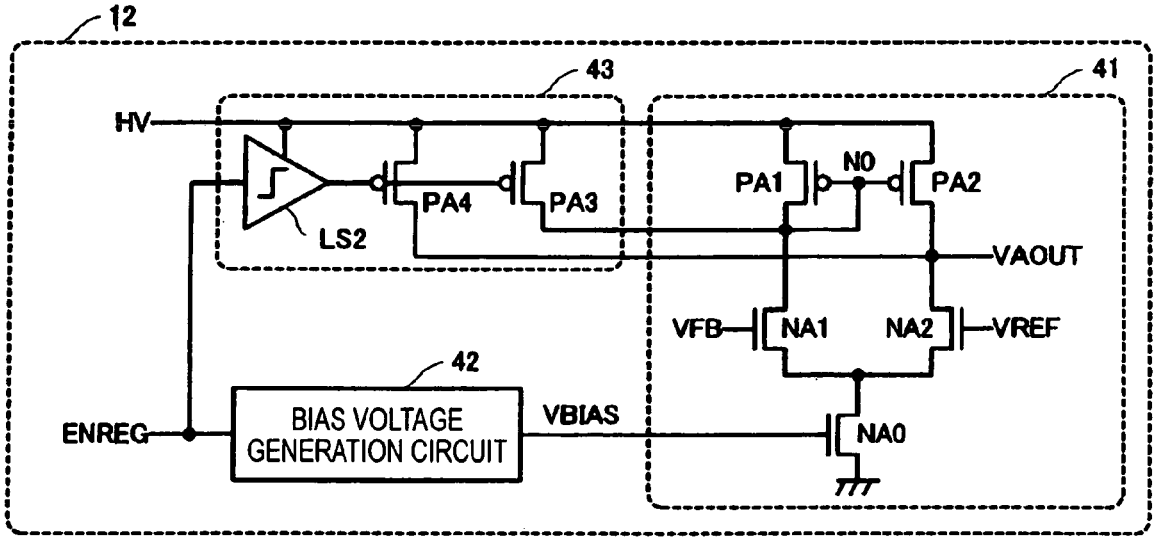
FIG. 3 is a diagram showing the arrangement of an operational amplification circuit according to the first embodiment.

FIG. 3 is a diagram showing the arrangement of an operational amplification circuit 12 according to this embodiment. The operational amplification circuit 12 includes: a differential amplification circuit 41, for comparing a reference voltage VREF with a feedback voltage VFB and for outputting a comparison result VAOUT; a bias voltage generation circuit 42, for generating a bias voltage VBIAS to activate the differential amplification circuit 41; and a differential amplification circuit halt circuit 43, for setting an output terminal VAOUT and a node N0 at a power voltage HV when the differential amplification circuit 41 is in the halted state.

The amplification circuit 41 includes: P-channel transistors PA1 and PA2, which form a current mirror circuit, a differential pair of N-channel transistors NA1 and NA2, and an N-channel transistor NA0, which is a constant current source.

The gate and the drain of the P-channel transistor PA1 and the gate of the P-channel transistor PA2 are connected in common to the node N0, and the sources of the P-channel transistors PA1 and PA2 are connected to the power source HV.

The drain of the P-channel transistor PA1 is connected to the drain of the N-channel transistor NA1, and the drain of the P-channel transistor PA2 and the drain of the N-channel transistor NA2 are connected in common to the output terminal VAOUT.

The feedback voltage VFB is applied to the gate of the N-channel transistor NA1, and the reference voltage VREF is applied to the gate of the N-channel transistor NA2. Further, the sources of the N-channel transistors NA1 and NA2 are connected in common, and the N-channel transistor NA0 is connected between this junction and the ground voltage terminal. A bias voltage VBIAS is applied to the gate of the N-channel transistor NA0 by the bias voltage generation circuit 42.

Based on the control signal ENREG, the bias voltage generation circuit 42 generates the bias voltage VBIAS. When the control signal ENREG is at level H, i.e., when the regulator circuit 120 is in the operating state, the bias voltage generation circuit 42 generates the bias voltage VBIAS, and the differential amplification circuit 41 is rendered active and compares the feedback voltage VFB with the reference voltage VREF. At this time, the bias voltage generation circuit 42 consumes a current of several tens of micro amperages to generate the bias voltage VBIAS.

When the control signal ENREG is at level L, i.e., when the regulator circuit 120 is in the halted state, the bias voltage generation circuit 42 is halted, and the ground voltage level is set for the output voltage VBIAS. At this time, the current consumed by the bias voltage generation circuit 42 is zero. Similarly, the current consumed by the differential amplification circuit 41 is also zero, and the regulator circuit 120 is completely halted.

The differential amplification circuit halt circuit 43 includes P-channel transistors PA3 and PA4 and a level shifter circuit LS2. The gates of the P-channel transistors PA3 and PA4 are connected to the output terminal of the level shifter circuit LS2, and the source is connected to the power source HV. Further, the drain of the P-channel transistor PA3 is connected to the node N0, and the drain of the P-channel transistor P4 is connected to the output terminal VAOUT.

The level shifter circuit LS2 shifts the voltage level of the control signal ENREG to the power voltage level HV, and the output voltage is applied to the gates of the P-channel transistors PA3 and PA4. When the control signal ENREG is at level H, i.e., when the regulator circuit 120 is in the operating state, the P-channel transistors PA3 and PA4 are rendered off and do not affect the operation of the differential amplification circuit 41. When the control signal ENREG is at level L, i.e., when the regulator circuit 120 is in the halted state, the P-channel transistors PA3 and PA4 are rendered on, and the power voltage HV is set for the node N0 and the output terminal VAOUT of the differential amplification circuit 41.

Various operations of the regulator circuit 120, according to the first embodiment, arranged as in FIG. 2, will now be described in detail.

Figure 4:
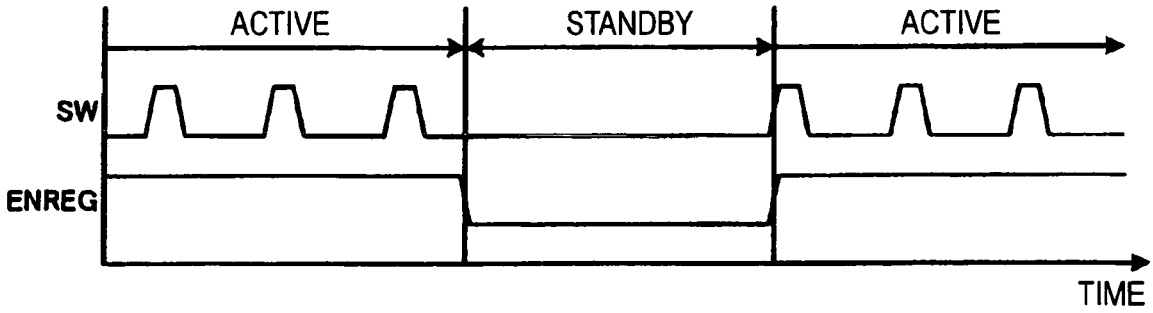
FIGS. 4A and 4B are diagrams showing waveforms for individual operations performed by the regulator circuit according to the first embodiment.
Figure 4:
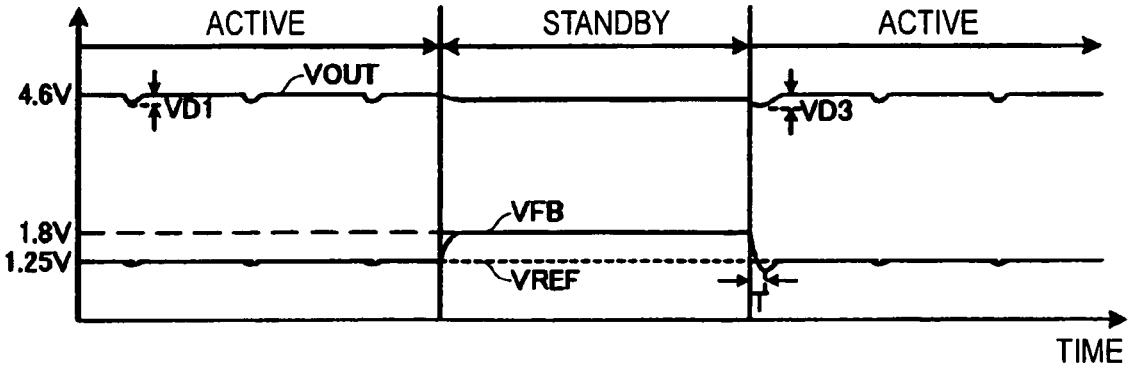

FIGS. 4A and 4B are diagrams showing waveforms for individual operations of the regulator circuit 120 according to this embodiment. As shown in FIG. 4A, when the control signal ENREG is at level H, the regulator circuit 120 is active (in the operating state), a current is supplied to a load circuit 31 when the load circuit 31 has consumed the current (a switch SW is at level H), and a steady output voltage VOUT is maintained.

When the control signal ENREG is at level L, the regulator circuit 120 is in the standby state (the halted state), and the current consumed by the detection circuit 11 and the operational amplification circuit 12 is zero. When the load circuit 31 is to consume a current while the regulator circuit 120 is in the standby state, the control signal ENREG goes to level H, and the regulator circuit 120 recovers from the standby state to the active state and begins to supply a current to the load circuit 31.

As shown in FIG. 4B, the output voltage VOUT of the regulator circuit 120 in the active state is 4.6 V. At this time, the P-channel transistor P1 of the connection/disconnection circuit 21 is rendered on by applying to the gate the ground voltage from the level shifter circuit LS1, while the output terminal of the detection circuit 11 is connected to the feedback input section VFB. Further, the P-channel transistor P2 of the voltage setup circuit 22 is rendered off by applying the internal power voltage (the control signal ENREG at level H) to the gate, so that the feedback input section VFB is not adversely affected. Since each time the load current circuit 31 consumes the current, the current is supplied by the regulator circuit 120, the drop in the output voltage VOUT is a very small value VD1, and the output voltage having a substantially constant value is maintained. At this time, the feedback voltage VFB, which is the input voltage for the operational amplification circuit 12, is equal to the reference voltage VREF (1.25 V).

When no current is consumed by the load circuit 31, the control signal ENREG goes to level L, and the regulator circuit 120 is shifted to the standby state. At this time, the current consumed by the detection circuit 11 and the operational amplification circuit 12 is zero. Further, the power voltage HV is output at the output terminal VAOUT by the operational amplification circuit 12, and as a result, the P-channel transistor P0 of the output circuit 13 is rendered off and the output terminal VOUT is set to the high impedance state. In the standby state, the output voltage VOUT, 4.6 V, used for the operation is maintained by a capacitance Cat a decoupling capacitor 30.

The P-channel transistor P1 of the connection/disconnection circuit 21 is rendered off by applying to the gate the power voltage HV from the level shifter circuit LS1, and the output terminal of the detection circuit 11 is disconnected from the feedback input section VFB.

Furthermore, the P-channel transistor P2 of the voltage setup circuit 22 is rendered on by applying the ground voltage (the control signal ENREG at level L) to the gate, and the internal power voltage of 1.8 V is set for the feedback input section VFB.

Figure 10:
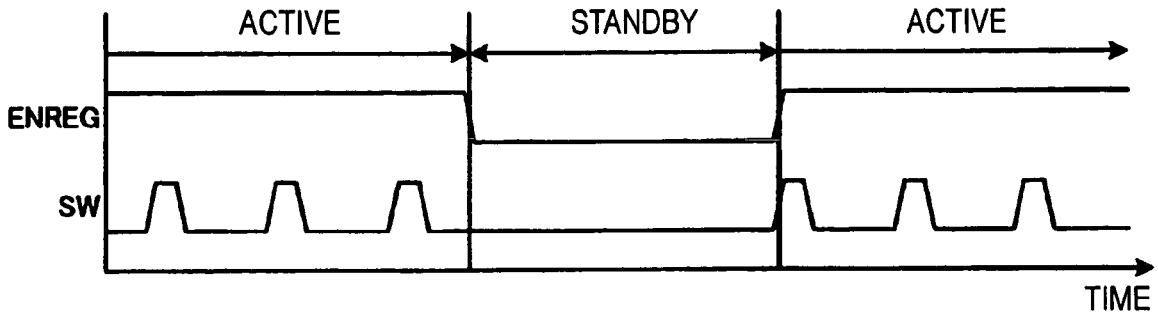
FIG. 10 is a diagram showing waveforms for individual operations performed by the conventional regulator circuit.
Figure 10:
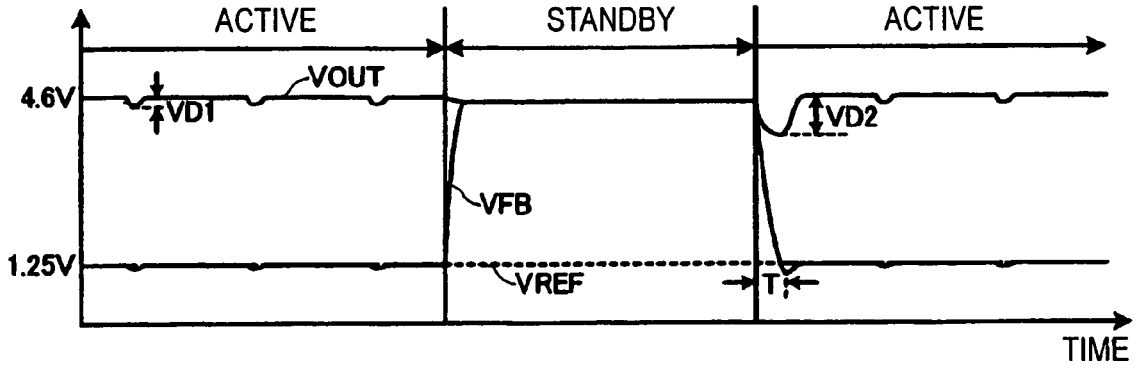

According to the conventional regulator circuit, as previously explained while referring to FIG. 10, in the standby state, the setting for the feedback input section VFB is near the output voltage of 4.6V. However, according to the regulator circuit 120 of this embodiment, in the standby state, the setting for the feedback input section VFB is the internal power voltage of 1.8 V.

When the load circuit 31 consumes current while the regulator circuit 120 is in the standby state, the control signal ENREG goes to level H, and the regulator circuit 120 recovers from the standby state to the active state and begins to supply current to the load circuit 31.

When the regulator circuit 120 has been shifted to the active state, the N-channel transistor NO of the detection circuit 11 is rendered on, the operational amplification circuit 12 is rendered active, and the regulator circuit 120 begins operation. Furthermore, the P-channel transistor P1 of the connection/disconnection circuit 21 is rendered on by applying to the gate the ground voltage from the level shifter circuit LS1, and the output terminal of the detection circuit 11 is connected to the feedback input section VFB.

In addition, the P-channel transistor P2 of the voltage setup circuit 22 is rendered off by applying the internal power voltage (the control signal ENREG at level H) to the gate, and the setting of the internal power voltage 1.8 V for the feedback input section VFB is canceled.

Then, the feedback input section VFB is shifted to the reference voltage VREF (1.25 V), which is the stable voltage for the operation of the regulator circuit 120. At this time, since the voltage of the feedback input section VFB in the standby state is the internal 1.8 V power voltage, a time T required before the regulator circuit 120 is shifted to the stable operating state is reduced, when compared with the time required for the conventional regulator circuit.

Therefore, the regulator circuit 120 can quickly recover, and a drop VD3 in the output voltage VOUT is sharply reduced, when compared with the conventional regulator circuit. Therefore, the capacitance C of the decoupling capacitor 30 need not be increased in order to prevent the drop in the output voltage VOUT, and the need to increase the chip area can be eliminated.

Moreover, when the standby state and the active state are switched frequently, the voltage for the feedback input section VFB can be quickly set, because the internal power voltage is employed and is set for the feedback input section VFB. Thus, rapid switching between the standby state and the active state of the regulator circuit is enabled.

Second Embodiment

Figure 5:
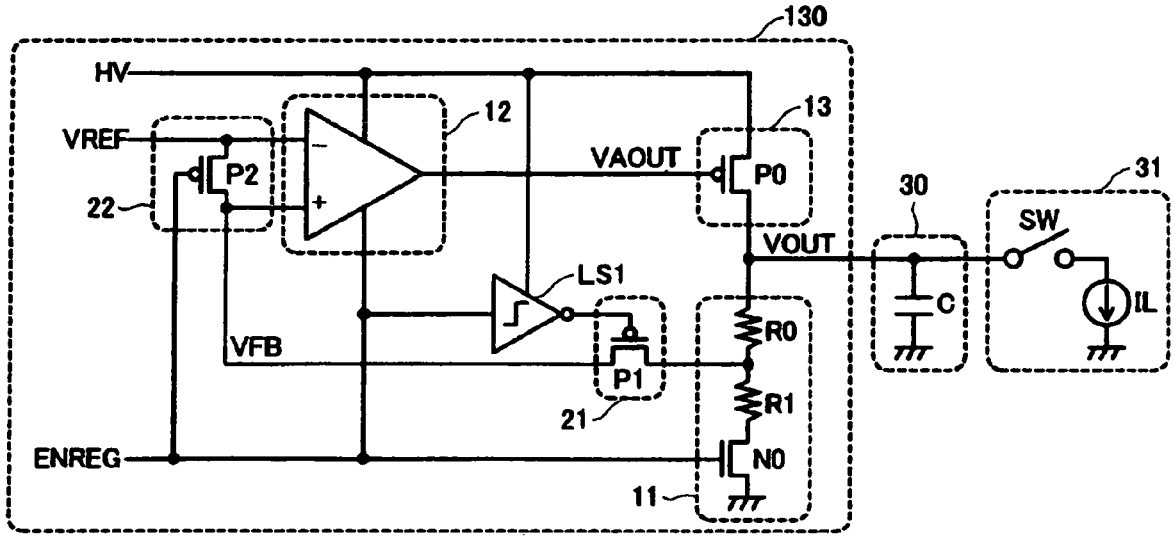
FIG. 5 is a diagram showing the configuration of a regulator circuit according to a second embodiment of the present invention.

FIG. 5 is a diagram showing the configuration of a regulator circuit according to a second embodiment of the present invention. In FIG. 5, the same reference numerals are used to denote components having the same functions as those for the regulator circuit in the first embodiment, and for them, no detailed explanation will be given. Only a different portions will now be explained.

A difference between a regulator circuit 130 of this embodiment and the regulator circuit of the first embodiment in FIG. 2 is the connection of a voltage setup circuit 22.

In FIG. 5, the voltage setup circuit 22 is constituted by a P-channel transistor P2. The gate of the P-channel transistor P2 is connected to a contact of a control signal ENREG, the source is connected to a contact for a reference voltage VREF, and the drain is connected to a feedback input section VFR.

The regulator circuit 130 in the second embodiment is characterized by being set at the reference voltage VREF by the P-channel transistor P2 when the regulator circuit 130 is in the standby state. With this arrangement, in the standby state, the voltage of the feedback input section VFB can be set for the reference voltage VREF, which is a voltage for a stable operation in the active state. Therefore, the regulator circuit 130 can quickly recover from the standby state to the active state.

However, when the voltage setup of the feedback input section VFB is performed frequently, noise may be injected into the reference voltage VRE, because the reference voltage VREF is employed for the voltage setup. Thus, when the regulator circuit is frequently shifted between the standby state and the active state, this embodiment need be applied while referring to the shifting frequency. However, since the voltage at the feedback input section VFB in the standby state equals the reference voltage VREF, in the standby state, the regulator circuit can at least quickly recover to the active state.

Third Embodiment

Figure 6:
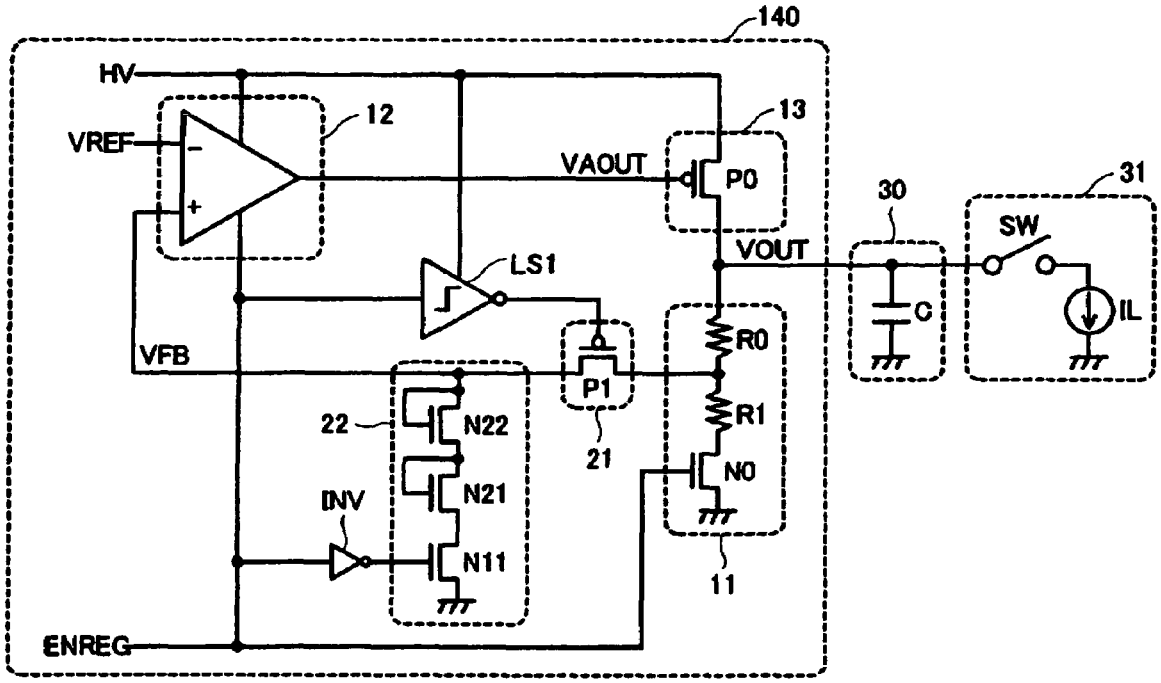
FIG. 6 is a diagram showing the configuration of a regulator circuit according to a third embodiment of the present invention.

FIG. 6 is a diagram showing the configuration of a regulator circuit according to a third embodiment of the present invention. In FIG. 6, the same reference numerals are employed to denote components having the same functions as those for the regulator circuit of the first embodiment, and for them, no detailed explanation will be given. Only a different portion will be explained.

A difference between a regulator circuit 140 of this embodiment and the regulator circuit 120 of the first embodiment in FIG. 2 is the arrangement of a voltage setup circuit 22.

In FIG. 6, the voltage setup circuit 22 includes N-channel transistors N11, N21 and N22. The gate of the N-channel transistor N11 is connected to the output terminal of an inverter circuit INV, and the source is connected to a ground voltage terminal. The drain of the N-channel transistor N11 and the source of the N-channel transistor N21 are connected in common, and the gate and the drain of the N-channel transistor N21 and the source of the N-channel transistor N22 are connected in common. The gate and the drain of the N-channel transistor N22 and a feedback input section VFB are connected in common. And the N-channel transistors N21 and N22 are connected in series as diode connection structures.

The inverter circuit INV is an inverter circuit that receives a control signal ENREG, and the output terminal is connected to the gate of the N-channel transistor N11.

When the control signal ENREG is at level H, i.e., when the regulator circuit 140 is active, the output of the inverter circuit INV is at level L, the N-channel transistor N11 is rendered off, and the voltage setup circuit 22 does not affect the feedback input section VFB.

When the control signal ENREG is at level L, i.e., when the regulator circuit 140 is in the standby state, the output of the inverter circuit INV is at level H, the N-channel transistor N11 is rendered on, and the feedback input section VFB is grounded via the N-channel transistors N11, N21 and N22.

Therefore, assuming that the threshold voltages of the N-channel transistors N21 and N22 are defined as Vt, in the standby state the feedback input section VFB is set at a voltage 2Vt by the diode-connected N-channel transistors N21 and N21. When the threshold voltages of the N-channel transistors N21 and N22 are near 0.625 V, in the standby state the feedback input section VFB is set at a voltage 1.25 V, which has the same potential as the reference voltage VREF. Therefore, the regulator circuit 140 can quickly recover from the standby state to the active state.

Fourth Embodiment

Figure 7:
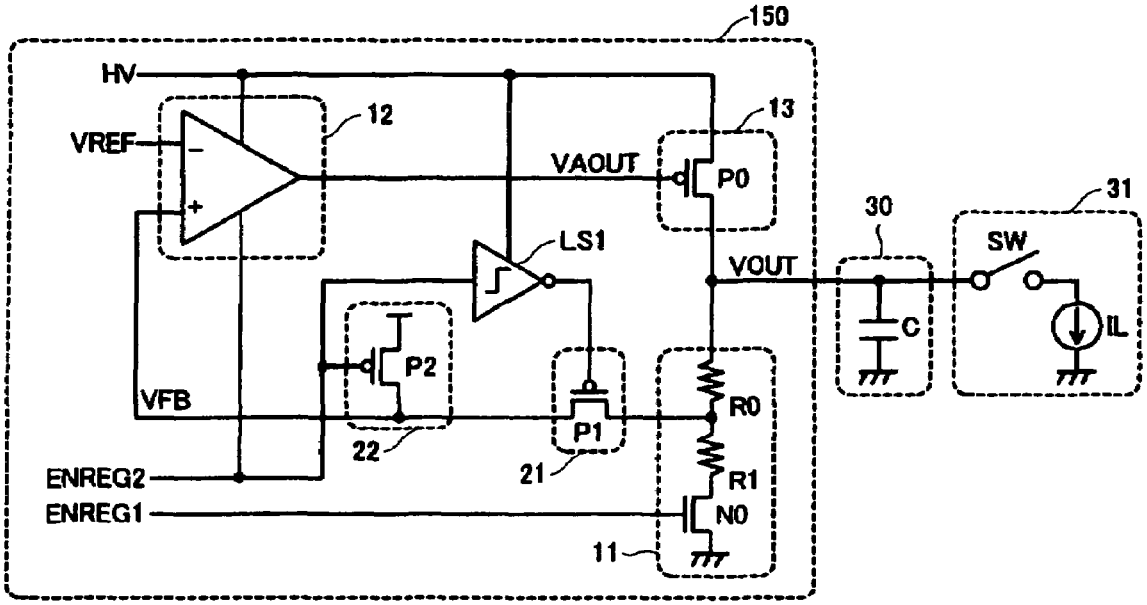
FIG. 7 is a diagram showing the configuration of a regulator circuit according to a fourth embodiment of the present invention.

FIG. 7 is a diagram showing the configuration of a regulator circuit according to a fourth embodiment of the invention. In FIG. 7, the same reference numerals are used to denote components having the same functions as those for the regulator circuit of the first embodiment, and for them, no detailed explanation will be given. Only different portions will be described.

The components of a regulator circuit 150 for this embodiment are the same as those for the regulator circuit 120 of the first embodiment in FIG. 2, except for a method for controlling a detection circuit 11, an operational amplification circuit 12, a connection/disconnection circuit 21 and a voltage setup circuit 22.

In FIG. 7, the operating state and the halted state of the detection circuit 11 are controlled in accordance with a control signal ENREG1. The operating states and the halted states of the operational amplification circuit 12, the connection/disconnection circuit 21 and the voltage setup circuit 22 are controlled in accordance with a control signal ENREG2.

Figure 8:
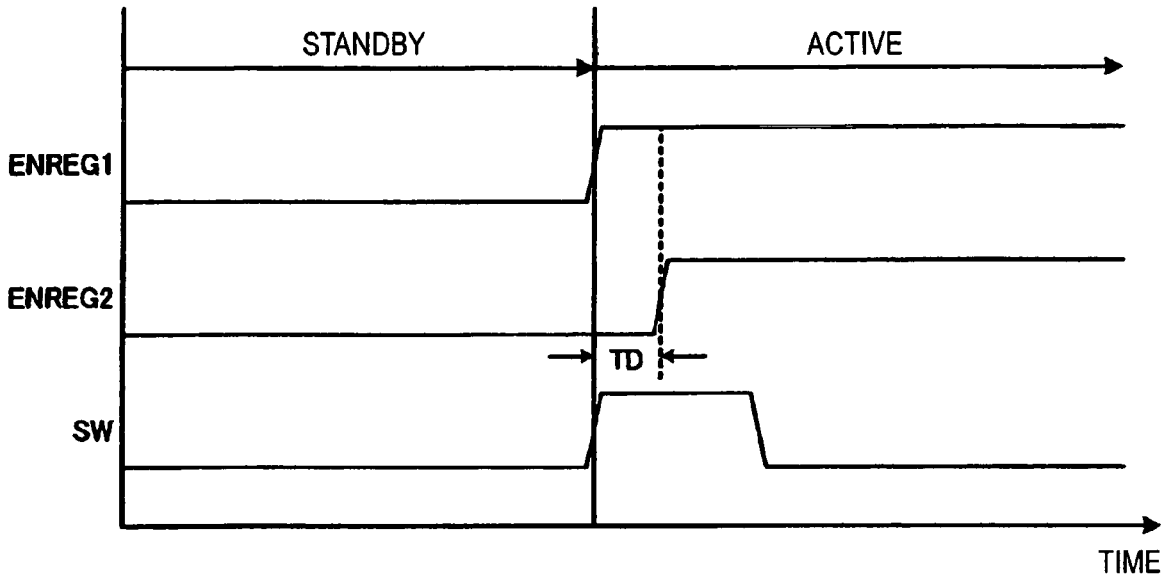
FIG. 8 is a diagram showing waveforms for individual operations performed by the regulator circuit according to the fourth embodiment.
Figure 9:
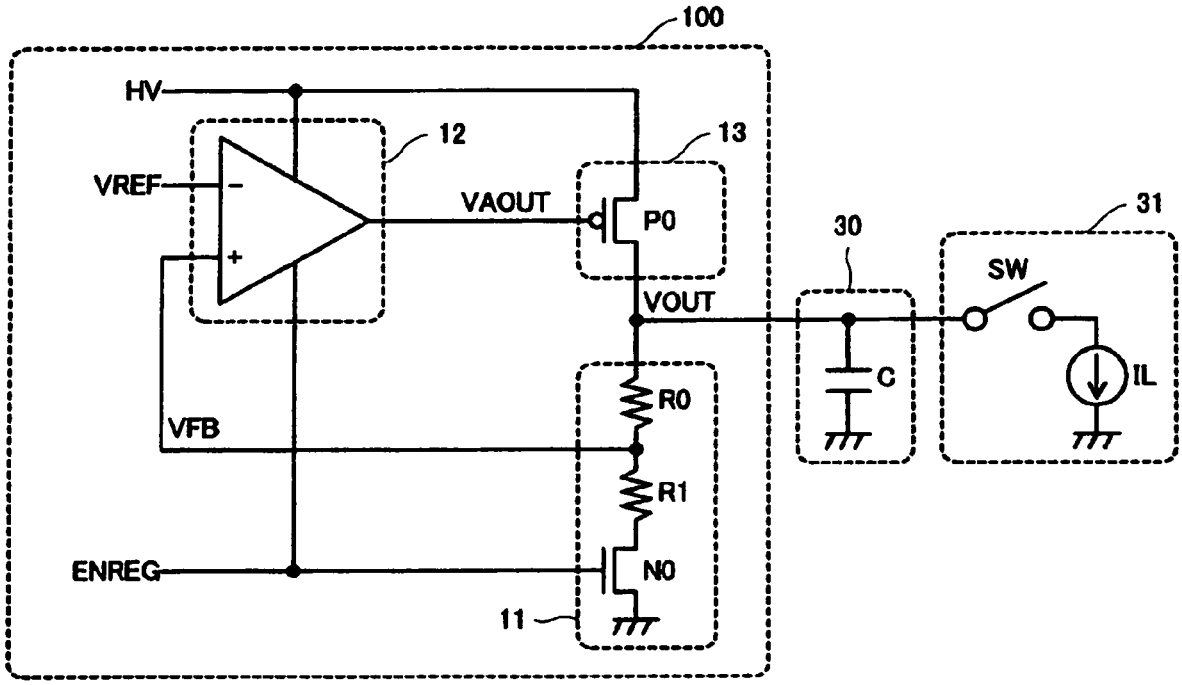
FIG. 9 is a diagram showing the configuration of a conventional regulator circuit.

FIG. 8 is a diagram showing waveforms for the individual operations of the regulator circuit 150 according to the fourth embodiment. In FIG. 8, the only waveforms shown are those for when the regulator circuit 150 is shifted from the standby state to the active state.

In FIG. 8, when the standby state is shifted to the active state, first, the control signal ENREG1 goes to level H. Then, the N-channel transistor N0 of the detection circuit 11 is rendered on, and the detection circuit 11 detects an output voltage VOUT and outputs a detected voltage. As a result, the output voltage of the detection circuit 11, i.e., a juncture of resistors R0 and R1, is moved from a point whereat there is a voltage of 4.6 V (VOUT), which is a voltage in the standby state, to a point whereat there is a voltage near 1.25 V (VREF), which is a stable operation point in the active state.

After predetermined time TD has elapsed, the control signal ENREG2 goes to level H, and the connection/disconnection circuit 21 connects the output terminal of the detection circuit 11 to the feedback input section VFB, the voltage setup circuit 11 is rendered inactive, and the operational amplification circuit 12 is activated.

At this time, the detection circuit 11 is in the operating state before it is connected to the feedback input section VFB by the connection/disconnection circuit 21. Thus, the output of the detection circuit 11 is a voltage (1.25 V) for a stable operation.

Therefore, the reference voltage VREF, which is a voltage for a stable operation, is more quickly set for the feedback input section VFB. As a result, the recovery operation for shifting the regulator circuit from the standby state to the active state can be performed at high speed.

The present invention has been described by referring to the first to the fourth embodiments. The regulator circuit of the invention is not limited to these embodiments, and various modifications can be applied without departing from the subject of the invention.

The regulator circuit according to the invention is characterized by being capable of quickly recovering from the standby state to the active state, and is effective, for example, as means for generating an internal power voltage for a semiconductor integrated circuit for which low power consumption is requested, and as means for generating a voltage required for data reading and writing relative to a semiconductor memory device.

What is claimed is:

1. A regulator circuit, comprising:

a control signal, driven by a power source having a first voltage level and controlling an operation and a halt of a regulator circuit;

a detection circuit, outputting a feedback voltage in accordance with an output voltage;

a reference voltage input section;

a feedback voltage input section;

an operational amplification circuit, comparing a reference voltage and the feedback voltage and outputting a voltage as a comparison result;

an output circuit, supplying an output voltage from a power source having a second voltage level which is higher than the first voltage level in accordance with the output of the operational amplification circuit;

a level shift circuit, voltage converting the control signal to the second voltage level;

a connection/disconnection circuit, controlled by an output of the level shift circuit, and connecting or disconnecting an output terminal of the detection circuit and the feedback voltage input section; and a voltage setup circuit, setting for the feedback voltage input section a predetermined voltage, wherein the control signal is comprised of a first control signal for controlling the detection circuit and a second control signal for controlling the level circuit, and wherein after a predetermined time elapses since the detection circuit is operated by the first control signal, the connection/disconnection circuit is controlled so as to connect the output terminal of the detection circuit and the feedback voltage input section by controlling the level shift circuit by the second control signal.

2. The regulator circuit according to claim 1, wherein, when the regulator circuit is activated, the detection circuit and the operational amplification circuit are activated and the output terminal of the detection circuit and the feedback voltage input section be connected by the connection/disconnection circuit, and the voltage setup circuit is set to the inactive state.

3. The regulator circuit according to claim 1, wherein, when the regulator circuit is halted, the detection circuit and the operational amplification circuit stop the consumption of current and halt operations, the output terminal of the detection circuit and the feedback voltage input section are disconnected by the connection/disconnection circuit, and for the feedback voltage input section a predetermined voltage is set by the voltage setup circuit.

4. The regulator circuit according to claim 1, wherein the connection/disconnection circuit includes a first P-channel transistor for connecting or disconnecting the output terminal of the detection circuit and the feedback voltage input section.

5. The regulator circuit according to claim 1, wherein the voltage setup circuit is capable of being set to a voltage near the reference voltage.

6. The regulator circuit according to claim 1, wherein the voltage setup circuit is capable of being set to an internal power voltage used inside a semiconductor integrated circuit.

7. The regulator circuit according to claim 6, wherein the voltage setup circuit includes a second P-channel transistor for setting the internal power voltage for the feedback voltage input section.

8. The regulator circuit according to claim 1, wherein that the voltage setup circuit is capable of be set to the reference voltage.

9. A regulator circuit according to claim 1, wherein the voltage setup circuit includes a third P-channel transistor for setting the reference voltage for the feedback voltage input section.

10. A regulator circuit according to claim 1, wherein the voltage setup circuit has a series-connection structure including at least one N-channel transistor, the gate and the drain of which are connected in common between the feedback voltage input section and a ground voltage terminal.

* * * * *